United States Patent [19]

Williams

[11] Patent Number: 4,478,371

[45] Date of Patent: Oct. 23, 1984

[54] FUEL GRINDING APPARATUS

[75] Inventor: Robert M. Williams, Ladue, Mo.

[73] Assignee: Williams Patent Crusher and Pulverizer Company, St. Louis, Mo.

[21] Appl. No.: 337,586

[22] Filed: Jan. 7, 1982

[51] Int. Cl.[3] ..... B02C 23/24

[52] U.S. Cl. ..... 241/18; 241/24; 241/30

[58] Field of Search ..... 241/18, 24, 30, 33, 241/34, 35, 36, 37, 53, 57, 58, 68, 79, 80, 97

[56] References Cited

U.S. PATENT DOCUMENTS 4,123,009 10/1978 Kilpinen ..... 241/34 X 4,184,640 1/1980 Williams ..... 241/68 X

*Primary Examiner*—Howard N. Goldberg

*Assistant Examiner*—Timothy V. Eley

*Attorney, Agent, or Firm*—Gravely, Lieder & Woodruff

[57] ABSTRACT

Apparatus for preparing fuel for delivery to a boiler or place where it is burned in which a grinding mill and a particle sizing classifier are operated to deliver fuel of a substantially uniform size, and means to operate the mill and classifier independently of the rate of supply of the fuel but in response to the differential pressure of the fluid bed depth in the mill.

3 Claims, 4 Drawing Figures

FUEL GRINDING APPARATUS7

BACKGROUND OF THE INVENTION

1. Field of the Invention

This invention relates to apparatus for grinding fuel preparatory to its delivery to a boiler or other point of use.

2. Description of the Prior Art

The most pertinent prior art is represented by the prior U.S. Pat. No. of Williams 4,184,640 of Jan. 22, 1980 and certain of the references, such as Williams, U.S. Pat. No. 3,337,142 of Aug. 22, 1967, Williams, U.S. Pat. No. 4,022,387 of May 10, 1977, and Dickey, U.S. Pat. No. 2,172,317 of Sept. 5, 1939.

In the Williams U.S. Pat. No. 4,184,640, the disclosure relates to operating the apparatus to maintain a fuel rate dependent on mill speed and consistent with boiler demand. The fuel rate is arrived at by varying the mill speed and the classifier speed inversely, while the air moving fan adjustment maintains a coal-to-air ratio suitable for the burner being supplied.

BRIEF SUMMARY OF THE INVENTION

The objects of the present invention are to provide fuel grinding apparatus operated by the fuel demand from the boiler, to provide a control for the grinding mill and its classifier which is independent of the fuel supply rate to provide a method to cause the mill grinding rate to keep up with the supply of fuel, and to provide a control for regulating the relationship between the mill grinding speed, the inversely operated speed of the classifier and the flow of air for moving the fuel to the boiler. Cp A preferred embodiment of this invention incorporates a source of fuel, a grinding mill to receive the flow of fuel at whatever pounds per hour (LBS/HR) is delivered, means to operate the grinding mill and an associated spinner separator or particle size classifier in a coordinated manner to deliver substantially uniform fuel particle size to the boiler, and a control for the grinding mill which will allow the grinding mill to operate at a speed to grind the fuel at whatever quantity is supplied so that the grinding mill and its classifier will operate independently of the supply and grind the fuel at whatever quantity it receives. In this embodiment the mill speed responds to the differential pressure of the fluid bed depth in the mill.

A copending patent application of Robert M. Williams, Ser. No. 364,968, filed Apr. 2, 1982 is directed to a method for obtaining the most efficient operation for grinding fuel by apparatus of the general character shown herein.

BRIEF DESCRIPTION OF THE DRAWINGS

The present embodiment is illustrated in the accompanying drawings wherein.

DETAILED DESCRIPTION OF THE PREFERRED EMBODIMENT

Figure 1:
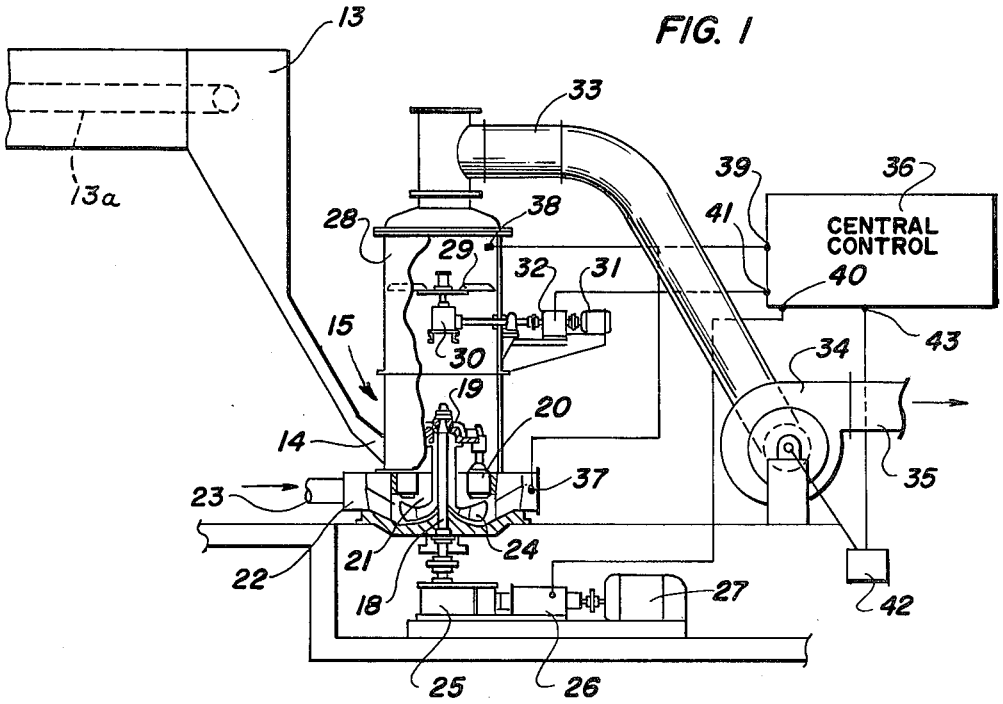
FIG. 1 is a schematic and partial sectional view of a fuel grinding system showing the organizational relationship of the various components to be described in more detail hereinafter.

Turning now to FIG. 1 there is illustrated a hopper 13 for the reception of a suitable fuel, which may be coal, or other combustible material, but basically coal. The fuel is brought to the hopper 13 on a suitable conveyor 13*a*. The hopper is connected to the inlet 14 of a grinding mill 15. The hopper 13, when filled with fuel serves as an air barrier so an air lock means at the inlet is not needed.

The grinding mill 15 has a vertical drive shaft 18, and connected at the upper end is a suitable head 19 which carries supports for grinding rolls 20 which operate to grind the fuel which is dumped into the grinding chamber 21 where the rolls can crush the fuel against a suitable bullring. The grinding chamber is surrounded by an air box or bustle 22 with an air inlet 23. The bustle is formed to direct the air flow into the bottom of the grinding chamber where a fluid bed of air and fuel is formed, and where rotary plows 24 constantly agitate and lift the fuel into the orbit of the rolls 20 in cooperation with said fluid bed. The vertical shaft 18 is connected by a suitable coupling into a transmission 25, and the transmission is operated through a variable speed control 26 by an electric motor 27.

The fuel in the fluid bed is crushed and ground in the chamber 21 and elevated by the air flow from the bustle 22 into a spinner separator or classifier device 28 which is mounted on top of the grinder 15 and is provided internally with spinner blades 29 driven through a suitable gear box 30 which, in turn, receives power input from the electric motor 31 driving the same through a speed control 32. The spinner blades 29 operate to force the larger particles of fuel to the outside of the classifier enclosure where they will return by gravity to the grinding chamber for further reduction. The fuel particles passing the classifier 28 are moved to a delivery conduit 33 which is connected to an air moving blower 34. The blower outlet 35 delivers the fuel to the boiler where it is consumed.

In FIG. 1 a central control means 36 is provided to monitor the various operating components of the grinding mill and classifier. For example, pressure sensitive elements 37 and 38 mounted respectively in the bustle 22 and in the spinner separator or classifier 28 generate signals which are transmitted into the control means 36 at 39. These devices 37 and 38 may constitute the sensitive portions of a monometer which is a well known device. The differential pressure signal delivered at 39 to the control means 36 is variable depending on the condition of the air movement and flow of fuel through the grinding chamber and the classifier, and is related to the fluid bed depth of fuel in the grinding chamber 21. The control means 36 is connected at 40 to the mill speed control 26, and is connected at 41 to the spinner separator speed control 32. These connections permit the control means 36 to monitor the respective speeds of the grinding rolls 20 and the spinner blades 29 so that they operate in an inverse relationship. That is to say, that as the grinding roller 20 speeds up, the spinner blades 29 slow down so as to produce a substantially uniform particle size.

The blower 34 is operated by motor 42 which is intended, under the connection at 43 to the control means 36, to maintain a minimum blower velocity such that the fuel will not be permitted to settle out in the conduit system. However, the blower needs to be operated under the direction of control means 36 at a velocity which will maintain the required "substantially constant" fuel to air ratio above the minimum air volume delivery.

Figure 2:
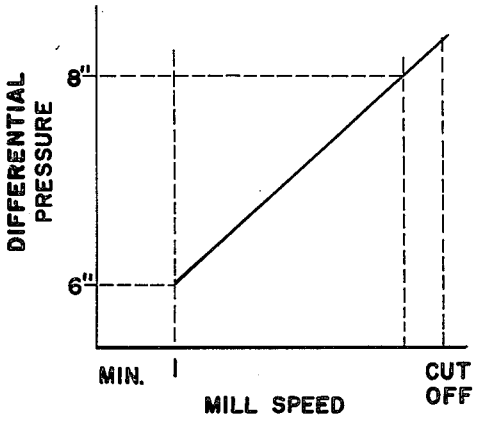
FIG. 2 is a chart illustrating the relationship between mill grinding speed and the differential pressure across the mill and its classifier.
Figure 3:
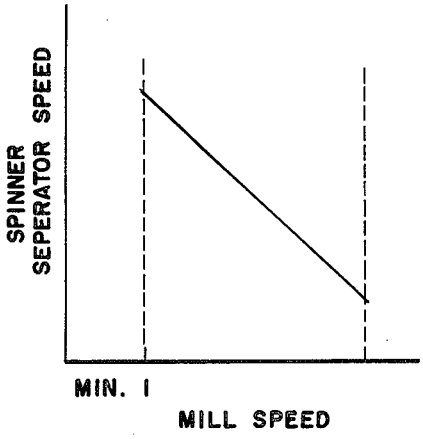
FIG. 3 is a further chart illustrating the inverse relationship between grinding mill speed and classifier speed.
Figure 4:
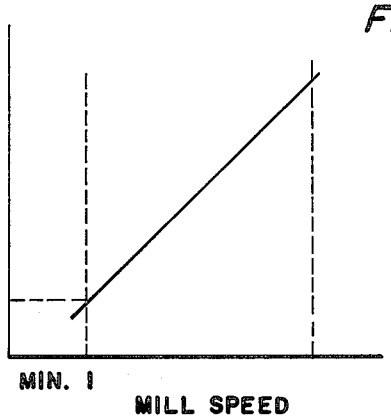
FIG. 4 is still another chart showing the relationship between grinding mill speed and volume of air flow above a minimum set point in cubic feet per minute.

The chart of FIGS. 2, 3 and 4 show the mill speed along the abscissa in each thereof. FIG. 2 shows the relationship between mill speed and differential pressure to illustrate that as the fluid bed depth of fuel in the grinding chamber 21 increases there is an increase in the differential pressure along the ordinate. As this occurs control means 36 tells the mill to grind faster. The mill speed control has a cutoff for safety. In the chart of FIG. 3 the variation in mill speed, when related to the speed of the spinner separator or classifier, depicts the relationship as being inverse such that as the mill speed slows down the spinner separator increases. This is so because the speed of the mill determines the amount of centrifugal force applied to the fuel particles. The chart of FIG. 4 illustrates the relationship between the mill speed and the output of the blower, as represented by the cubic feet per minute delivered. It is shown that the blower must operate from and above a minimum speed for delivery of the volume of air required to prevent the fuel particles from settling out in the duct work in the manner pointed out above. Also, as the bed depth of fuel increases the mill must speed up to grind that increase, and the fan must draw in more air to sweep the fuel out of the grinding chamber. These events are tied together to maintain a manageable fuel depth in the grinding chamber, and a substantially constant fuel-to-air ratio.

It can now be appreciated that the preparation of the fuel by grinding is independent of the fuel delivery. All that the mill knows is that it must operate to grind faster or slower depending on the quantity of fuel in the chamber 21. The air supply at 23 by operation of fan 34 is in such volume as to maintain the differential pressure across the fluid bed in the grinding chamber at the predetermined value of chart of FIG. 2 as fuel is fed into the grinding chamber. Control means 36 regulates the centrifugal grinding force and the air supply within that differential pressure range. That quantity of fuel forms a fluid bed and the depth of the fluid bed is sensed by the differential pressure sensors. The control means 36 is set to operate within certain fluid bed depth limits as measured by differential pressure as resistance to air movement in the mill is created by the depth of the fuel in the grinding chamber. The example of FIG. 2 is to relate the mill speed to operate at some speed where the fluid bed depth is sensed between differential pressures in inches of water. While the differential pressure in the grinding chamber has a predetermined range, the chart shows those values are 6 to 8 inches but, these may be changed as required. The broad principal is that the mill needs to grind at a speed to keep up with boiler demand.

The foregoing specification has set forth a preferred embodiment of the fuel grinding apparatus. However, it is to be understood that modifications may come to mind by those skilled in the art after considering the disclosure.

What is claimed is:

1. A method of operating a fuel grinding apparatus independently of the rate at which fuel arrives at the grinding apparatus which includes:

(a) feeding the fuel into a grinder and a classifier;

(b) classifying the fuel to a substantially uniform particle size;

(c) supplying air into the grinder to create a fluid bed of fuel, and for moving the ground fuel to a boiler at a substantially constant air to fuel ratio;

(d) sensing a differential pressure across the fluid bed;

(e) and varying the grinder and classifier at speeds to maintain the differential pressure across the fluid bed at a predetermined value and to maintain the substantially constant air to fuel ratio while grinding the fuel independently of the rate of arrival of the fuel into the grinder.

2. A method of operating a fuel grinding apparatus independently of the rate of feed of a fuel which includes:

(a) centrifugally grinding fuel at a varying speed in a fuel receiving grinding and classifying chamber;

(b) classifying the fuel to a substantially uniform particle size;

(c) supplying air to the chamber for forming a fluid fuel bed and maintaining a substantially constant air to fuel ratio;

(d) sensing the differential pressure in the chamber as a function of the depth of the fluid fuel bed;

(e) and varying the centrifugal grinding and classifying and the air supply within a predetermined range of differential pressure to maintain the substantially constant air to fuel ratio which is independent of the rate of feed of the fuel.

3. A method of operating a fuel grinding apparatus independently of the rate of feed of a fuel which includes:

(a) feeding fuel into a grinder and classifier;

(b) classifying the fuel to a substantially uniform particle size;

(c) supplying air into the grinder to create a fluid bed of fuel, and for moving the ground fuel to a boiler at a substantially constant air to fuel ratio;

(d) sensing a differential pressure across the fluid bed;

(e) and varying the grinding and air supply to maintain the differential pressure across the fluid bed at a predetermined value to maintain the substantially constant air to fuel ratio while grinding the fuel independently of the rate of arrival of the fuel into the grinder.

* * * * *